US006459352B1

(12) United States Patent
Liu et al.

(10) Patent No.: US 6,459,352 B1
(45) Date of Patent: Oct. 1, 2002

(54) ON-CHIP TRANSFORMERS

(75) Inventors: Q. Z. Liu, Irvine, CA (US); David Howard, Irvine, CA (US)

(73) Assignee: Skyworks Solutions, Inc., Newport Beach, CA (US)

( * ) Notice: Subject to any disclaimer, the term of this patent is extended or adjusted under 35 U.S.C. 154(b) by 18 days.

(21) Appl. No.: 09/779,402

(22) Filed: Feb. 8, 2001

(51) Int. Cl.[7] ..... H01F 5/00
(52) U.S. Cl. ..... 336/200; 336/223; 336/232
(58) Field of Search ..... 336/200, 223, 336/232; 29/602.1

(56) References Cited

U.S. PATENT DOCUMENTS 6,309,944 B1 * 10/2001 Sheng et al. ..... 438/401
6,417,755 B1 * 7/2002 Liu et al. ..... 336/200

* cited by examiner

*Primary Examiner*—Anh Mai
(74) *Attorney, Agent, or Firm*—Farjami & Farjami LLP

(57) ABSTRACT

In an exemplary embodiment of the disclosed transformer, the transformer comprises a dielectric area. For example, the dielectric area can consist of three different dielectric layers. Also, by way of example, the dielectric area can comprise silicon dioxide or a low-k dielectric. According to the exemplary embodiment, the dielectric area is interspersed with a permeability conversion material. The permeability conversion material has a permeability higher than the permeability of the dielectric area. For example, the permeability conversion material can be nickel, iron, nickel-iron alloy, or magnetic oxide. The exemplary embodiment further comprises a first conductor and also a second conductor patterned into the dielectric area. The first and/or the second conductor can comprise copper, aluminum, or a copper-aluminum alloy. Each of the first and second conductors are made up of a number of turns which result in, respectively, the primary and secondary windings of the exemplary disclosed transformer.

19 Claims, 5 Drawing Sheets

ON-CHIP TRANSFORMERS

BACKGROUND OF THE INVENTION

1. Field of the Invention

The present invention is generally in the field of fabrication of electronic circuit components. In particular, the present invention is in the field of fabrication of transformers used in electronic circuits.

2. Background Art

It is known in the art that there is an ever-present demand for decreasing electronic circuit component sizes and geometries. The demand is fueled, in large part, by the consumers' desire for ever-smaller communication and information processing devices, such as cellular telephones, laptop computers, and hand-held information assistants. The requirement to decrease the size of these consumer communication and information processing devices has resulted, among other things, in a need to reduce the size of the electronic components these devices contain. As a result, semiconductor device sizes and geometries have decreased dramatically, with each unit area of the semiconductor die supplying greater computing power and functionality. This has resulted in Ultra Large Scale Integration (ULSI) chips containing over a million components per chip. However, the transformer, an off-chip electronic component, has not benefited from this dramatic decrease in size.

The discrete, off-chip transformer suffers from various disadvantages not shared by on-chip electronic components. The off-chip transformer eventually goes through a wire bond for connection to on-chip circuitry. The off-chip transformer also requires assembly of at least two components (i.e. the chip itself and the off-chip transformer). The required assembly of two or more components introduces corresponding reliability issues and also results in a greater manufacturing cost.

By way of background, a transformer is comprised essentially of two cross-coupled inductors. The magnetic coupling between the two inductors is called mutual inductance. Discrete inductors are typically coils wound around a common core. The quality factor ("Q") of an inductor is determined by Q=L/R, where L is the inductance and R is the resistance inherent in the inductor. A relatively low quality factor signifies a relatively high energy loss. Since it is desirable to have a large quality factor in an inductor, it is desirable to have a large quality factor in each of the transformer's separate inductors. This can be accomplished by either increasing the inductance of the inductors, or decreasing their respective resistances.

The problems encountered when attempting to increase inductance or reduce resistance can be illustrated by using the example of an on-chip square spiral inductor. Such an inductor is disclosed in a co-pending United States patent application entitled "Method for Fabrication of On-Chip Inductors and Related Structure," Ser. No. 09/627,505 filed Jul. 28, 2000, and assigned to the assignee of the present application. The disclosure in that co-pending application is hereby incorporated fully by reference into the present application. As discussed in that co-pending application, the inductance of a conventional on-chip square spiral inductor can be increased by increasing the spiral diameter of the on-chip inductor. However, such an increase would make the conventional on-chip inductor even larger and would require even more chip space. For example, typical inductor values for a square spiral inductor used in mixed signal circuits and in RF applications range from 1 to 100 nano-henrys. If a circuit in a semiconductor chip required a square spiral inductor with a value of 30 nano-henrys and a fabrication process with a metal pitch of 5.0 microns is used, the inductor would require 17 metal turns and would have a spiral diameter of approximately 217 microns. As such, even a 30 nano-henry conventional on-chip inductor would require a considerable amount of chip space.

For the square spiral on-chip inductor in our example, for a given spiral diameter, the inductance is proportional to $n^2$, where n is the number of metal turns. Therefore, the inductance can be increased by increasing the number of turns. However, as the number of metal turns increases, the overall resistance of the metal turns will also increase. The increase in the overall resistance of the inductor will decrease the quality factor of the inductor. Thus, if the on-chip inductor in our example were coupled with another similar on-chip inductor to create a transformer, there would be a significant energy loss in the transformer.

Turning attention again to off-chip transformers, a discrete (i.e. off-chip) transformer also requires relatively long off-chip wires and interconnect lines to connect the transformer terminals to on-chip devices. The relatively long off-chip wires and interconnect lines result in added and unwanted resistance, capacitance, and inductance. Energy would be lost due to this unwanted resistance, capacitance, and inductance. Additionally, the interconnects for off-chip transformers are subject to long-term damage from vibration, corrosion, chemical contamination, oxidation, and other chemical and physical forces. Exposure to vibration, corrosion, chemical contamination, oxidation, and other chemical and physical forces results in lower long-term reliability for off-chip transformers.

Surface-mount packages that integrate both isolation transformers and common mode chokes utilizing the same footprint as discrete transformer-only products have been used to optimize board layout by allowing more functionality in the same amount of space. This approach has been necessitated by the ever higher density requirements of telephony and networking devices such as ISPs, multiplexers, wide area networks (WANS), internetworking interfaces, digital access and cross connect systems (DACS), channel banks and cellular base stations. Although this is an important step in meeting the need for reduced-size transformers, these modules are still discrete devices. They still require board assembly, with its attendant manufacturing cost and reliability issues.

Planar-transformer technology is another attempt at reducing transformer size. In this technology, multiple layers of a multilayer printed circuit board ("PCB") are sandwiched together to form the transformer windings. The core is formed in two sections that reside on the top and bottom of sandwiched windings. This technology reduces the transformer size and provides adequate unit-to-unit repeatability. However, as with surface-mount packages, planar-transformers are discrete devices that still require board assembly.

To applicants' knowledge, there are no known attempts to fabricate on-chip transformers. However, even if such an attempt were made, it would be very difficult to place a transformer inside the semiconductor die using presently known techniques. Some of the reasons for this difficulty include the following. First, fabricating each of the required on-chip inductors with high inductance values for use as a transformer winding is difficult because the size of the inductor is too large for the semiconductor die. Some of the reasons for the large size of conventional on-chip inductors were discussed above. Thus, the individual inductor's size limits the use of on-chip inductors to build on-chip transformers for RF and mixed signal circuits. Second, the inductor's quality factor would be too low. As explained above, when a higher inductance is desired and is achieved by increasing the number of metal turns, i.e. the windings, of the inductor, the corresponding increase in the resistance of the inductor results in a lower quality factor.

Thus, there is a need in the art for a transformer that has a small size, high quality factor inductor windings, is reliable, cost-effective, and which does not require connections through off-chip wires or off-chip interconnect lines.

SUMMARY OF THE INVENTION

The present invention is directed to on-chip transformers. The present invention discloses a transformer which has a small size, high quality factor inductor windings, is reliable, cost-effective, and which does not require connections through off-chip wires or off-chip interconnect lines.

In an exemplary embodiment of the invention's transformer, the transformer comprises a dielectric area. For example, the dielectric area can consist of three different dielectric layers. Also, by way of example, the dielectric area can comprise silicon dioxide or a low-k dielectric. According to the exemplary embodiment, the dielectric area is interspersed with a permeability conversion material. The permeability conversion material has a permeability higher than the permeability of the dielectric area. For example, the permeability conversion material can be nickel, iron, nickel-iron alloy, or magnetic oxide.

The exemplary embodiment of the invention's transformer further comprises a first conductor and also a second conductor patterned into the dielectric area. The first and/or the second conductor can comprise, for example, copper, aluminum, or a copper-aluminum alloy. Each of the first and second conductors are made up of a number of turns which result in, respectively, the primary and secondary windings of the exemplary embodiment of the invention's transformer.

DETAILED DESCRIPTION OF THE INVENTION

The present invention is directed to on-chip transformers. The following description contains specific information pertaining to different types of materials, layouts, dimensions, and implementations of the invention's transformer. One skilled in the art will recognize that the present invention may be practiced with material, layout, or dimensions, different from those specifically discussed in the present application. Moreover, some of the specific details of the invention are not discussed in order not to obscure the invention. The specific details not described in the present application are within the knowledge of a person of ordinary skills in the art.

The drawings in the present application and their accompanying detailed description are directed to merely example embodiments of the invention. To maintain brevity, other embodiments of the invention that use the principles of the present invention are not specifically described in the present application and are not specifically illustrated by the present drawings.

Figure 1:
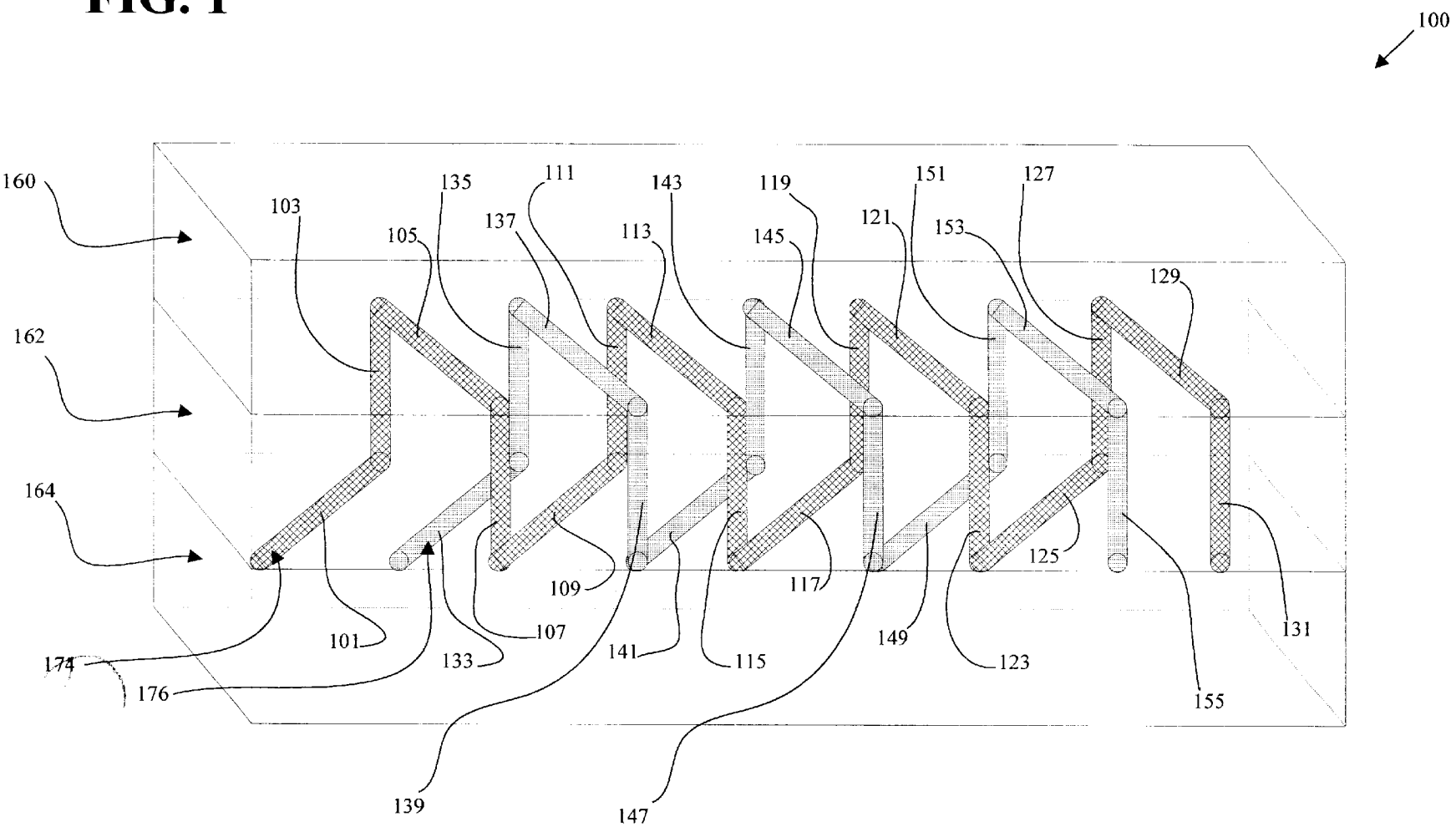
FIG. 1 illustrates a perspective view of an embodiment of the invention's transformer.
Figure 2A:
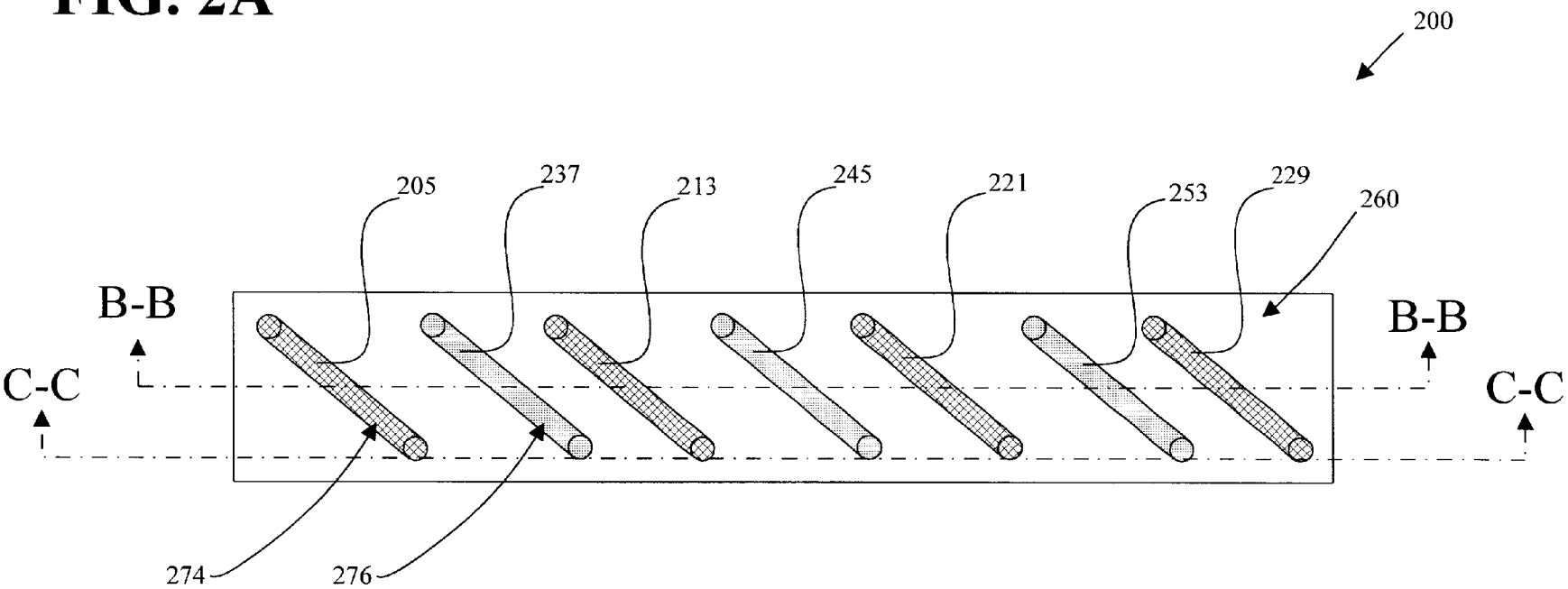
FIG. 2A illustrates a top view of the embodiment of the invention's transformer shown in FIG. 1.
Figure 2B:
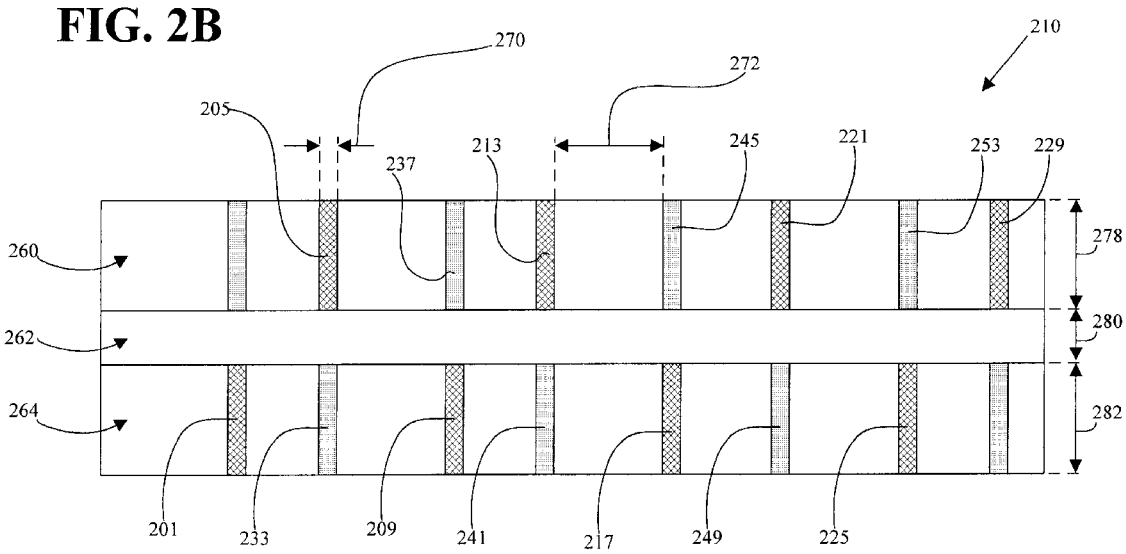
FIG. 2B illustrates a cross-sectional view along the line B—B in FIG. 2A of the embodiment of the invention's transformer shown in FIG. 1.
Figure 2C:
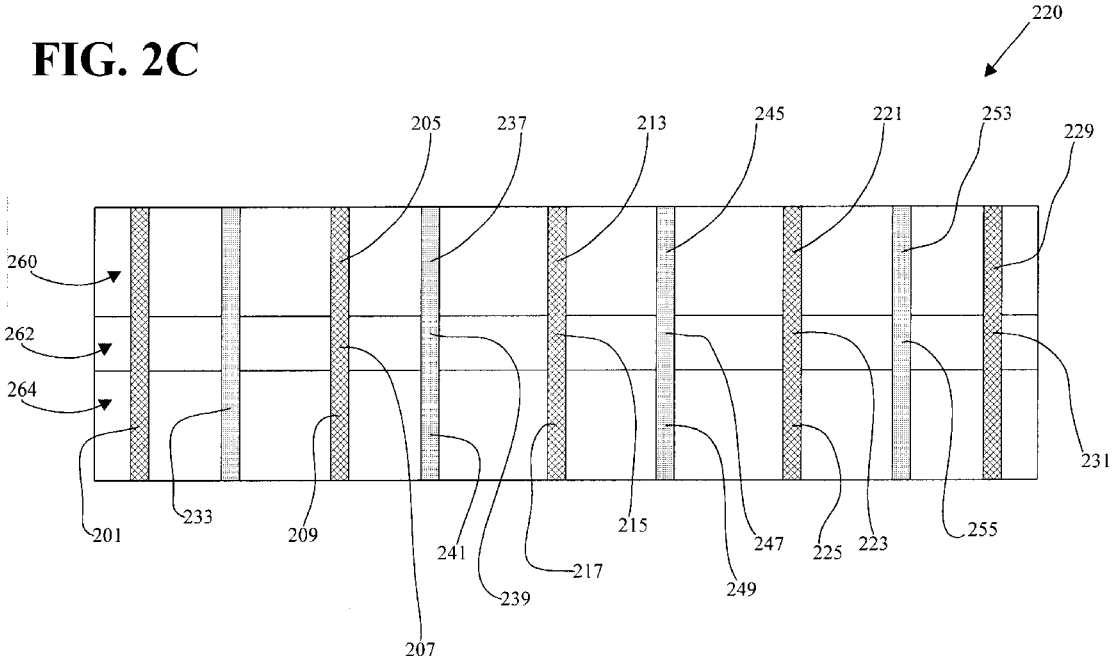
FIG. 2C illustrates a cross-sectional view along the line C—C in FIG. 2A of the embodiment of the invention's transformer shown in FIG. 1.

FIG. 1 shows perspective view 100 of an exemplary embodiment of the invention's transformer. The present embodiment's transformer, whose perspective view 100 is shown in FIG. 1, is used for illustration purposes only. In other words, FIG. 1 does not depict the relative sizes of various elements, and does not show the relative thicknesses and depths of various elements and is not drawn to scale. Also, FIG. 1 shows only a section of the invention's transformer. FIG. 2A shows a top view 200 of the invention's transformer corresponding to perspective view 100 of the same transformer shown in FIG. 1. FIG. 2B shows cross-sectional view 210 along line B—B of FIG. 2A of the same transformer while FIG. 2C shows cross-sectional view 220 along line C—C of FIG. 2A of that same transformer. As such, FIGS. 1, 2A, 2B, and 2C depict various views of the same exemplary embodiment of the invention's transformer.

In FIG. 1, the primary winding of the invention's transformer, also called a "first conductor" in the present application, is referred to generally by numeral 174. In the present example, primary winding 174 consists of a number of "turns" made up of segments 101, 103, 105, 107, 109, 111, 113, 115, 117, 119, 121, 123, 125, 127, 129, and 131. The secondary winding of the invention's transformer, also called a "second conductor" in the present application, is referred to generally by numeral 176. In the present example, secondary winding 176 consists of a number of "turns" made up of segments 133, 135, 137, 139, 141, 143, 145, 147, 149, 151, 153, and 155.

The primary winding 174 segments 101, 103, 105, 107, 109, 111, 113, 115, 117, 119, 121, 123, 125, 127, 129, and 131 can be grouped into via metal segments 103, 107, 111, 115, 119, 123, 127, and 131, and interconnect metal segments 101, 105, 109, 113, 117, 121, 125, and 129. Likewise, the secondary winding 176 segments 133, 135, 137, 139, 141, 143, 145, 147, 149, 151, 153, and 155 can be grouped into via metal segments 135, 139, 143, 147, 151, and 155, and interconnect metal segments 133, 137, 141, 145, 149, and 153.

As stated above, FIG. 2A represents top view 200 of the invention's transformer whose perspective view 100 was shown in FIG. 1. As such, dielectric layer 260 in FIG. 2A corresponds to dielectric layer 160 in FIG. 1. As stated above, FIGS. 2B and 2C show two different cross-sectional views 210 and 220 corresponding to perspective view 100 of the invention's transformer shown in FIG. 1. As seen in FIG. 2A, cross-sectional view 210 in FIG. 2B is taken along line B—B which is deep inside the invention's transformer. Further, as seen in FIG. 2A, cross-sectional view 220 in FIG. 2C is taken along line C—C that is at the outside edge of the invention's transformer. Dielectric layer 260 in FIG. 2B and dielectric layer 260 in FIG. 2C correspond to dielectric layer 260 in FIG. 2A and also to dielectric layer 160 in FIG. 1. Dielectric layer 262 in FIG. 2B and dielectric layer 262 in FIG. 2C correspond to dielectric layer 162 in FIG. 1. Dielectric layer 264 in FIG. 2B and dielectric layer 264 in FIG. 2C correspond to dielectric layer 164 in FIG. 1. Dielectric layers 260, 262, and 264 are also collectively referred to as a "dielectric area" in the present patent application.

Also, in the present embodiments of the invention as well as in other embodiments not discussed herein, there can be a dielectric layer below dielectric layer 264 and/or a dielectric layer above dielectric layer 260. Dielectric layers which can exist below dielectric layer 264 and above dielectric layer 260 are not shown in the drawings of the present application to preserve simplicity. Nevertheless, the existence and methods for fabrication of such additional dielectric layers are known to a person of ordinary skill in the art.

Interconnect metal segments 205, 213, 221, and 229 of primary winding 274 shown in FIGS. 2A, 2B, and 2C correspond respectively to interconnect metal segments 105, 113, 121, and 129 of primary winding 174 shown in FIG. 1. Likewise, interconnect metal segments 237, 245, and 253 of secondary winding 276 in FIGS. 2A, 2B, and 2C correspond respectively to interconnect metal segments 137, 145, and 153 of secondary winding 176.

Interconnect metal segments 205, 213, 221, 229, 237, 245, and 253 in FIGS. 2B and 2C are shown extending through dielectric layer 260, whereas corresponding interconnect metal segments 105, 113, 121, 129, 137, 145, and 153 in FIG. 1 are shown only on the bottom plane of dielectric layer 160.

Interconnect metal segments 201, 209, 217, and 225 of primary winding 274 in FIGS. 2B and 2C, correspond to interconnect metal segments 101, 109, 117, and 125 of primary winding 174 in FIG. 1. Also, interconnect metal segments 233, 241, and 249 of secondary winding 276 in FIGS. 2B and 2C correspond to interconnect metal segments 133, 141, and 149 of secondary winding 176 in FIG. 1.

Via metal segments 207, 215, 223, and 231 of primary winding 274 in FIG. 2C correspond to via metal segments 107, 115, 123, and 131 of primary winding 174 in FIG. 1. Via metal segments 239, 247, and 255 of secondary winding 276 in FIG. 2C correspond to via metal segments 139, 147, and 155 of secondary winding 176 in FIG. 1. Via metal segments 207, 215, 223, and 231 of prim ary winding 274 in FIG. 2C and via metal segments 239, 247, and 255 of secondary winding 276 in FIG. 2C are not shown in FIG. 2B because cross-sectional view 210 in FIG. 2B is taken along line B—B which is deep inside the invention's transformer, whereas cross-sectional view 220 in FIG. 2C is taken along line C—C which is at the outside edge of the invention's transformer.

As shown in FIG. 2B, the separation between each interconnect metal segment of primary winding 274 and an immediately adjacent interconnect metal segment of secondary winding 276 is indicated by numeral 272. In the present embodiment of the invention, separation 272 is between approximately 0.25 and approximately 10 microns. However, separation 272 may vary without departing from the scope of the present invention. As shown in FIG. 2B, the width of the interconnect metal segments in primary winding 274 and the width of interconnect metal segments in secondary winding 276 is referred to by numeral 270 in FIG. 2B. In the present embodiment of the invention, width 270 is between approximately 0.25 and 10 microns. However, width 270 may vary without departing from the scope of the present invention.

As shown in FIG. 2B, the thickness of dielectric layer 260 is referred to by numeral 278. Further, as shown in FIG. 2B, the thickness of dielectric layer 264 is referred to by numeral 282. In the present embodiment of the invention, thickness 278 of dielectric layer 260 is between approximately 1,000 and 30,000 Angstroms while thickness 282 of dielectric layer 264 is also between approximately 1,000 and 30,000 Angstroms. However, thicknesses 278 and 282 may vary without departing from the scope of the present invention. As further shown in FIG. 2B, the thickness of dielectric layer 262 is referred to by numeral 280 in FIG. 2B. In the present embodiment of the invention, thickness 280 of dielectric layer 262 is between approximately 1,000 and 6,000 Angstroms. However, thickness 280 may vary without departing from the scope of the present invention.

In two alternative embodiments of the present invention, interconnect metal segments, such as interconnect metal segments 105 and 137 in the primary and secondary windings (FIG. 1), may be patterned within dielectric layer 160 (FIG. 1) by either a damascene process or by a subtractive etching process. Similarly, interconnect metal segments, such as interconnect metal segments 109 and 133 in the primary and secondary windings, may be patterned within dielectric layer 164 by either a damascene process or by a subtractive etching process. In the damascene process, trenches are cut into the dielectric and then filled with metal. Then excess metal over the wafer surface is removed by a chemical mechanical polish process ("CMP") to form desired interconnect metal patterns within the trenches. Generally copper is used in a damascene process; however, other metals such as aluminum can also be used. In the subtractive etching process, a blanket layer of metal is uniformly deposited on a given surface. Thereafter, through masking and etching steps, a desired pattern is formed by etching away the unwanted portions of the blanket layer of metal. As such, what remains is a desired pattern of interconnect metal. Generally aluminum or aluminum-copper alloys are used in a subtractive etching process; however, other metals can also be used.

Via metal segments, such as via metal segments 103 and 107 in the primary winding 174 in FIG. 1 and via metal segments 135 and 139 in the secondary winding 176 in FIG. 1, may be fabricated in a damascene process using copper or tungsten and in a subtractive etching process using tungsten in a manner known in the art. Moreover, in a damascene process, via metal segments may be fabricated by using either a "via first" or a "trench first" process, which are both known in the art. Generally, the dielectric material that comprises dielectric layers 260, 262 and 264 (FIGS. 2B and 2C) can be silicon dioxide, or a low-k dielectric such as porous silica, fluorinated amorphous carbon, fluoropolymer, parylene, polyarylene ether, silsesquioxane, fluorinated silicon dioxide, and diamondlike carbon.

By way of background, when a material is placed within the magnetic field of an inductor, the magnetic dipoles of the material interact with the magnetic field created by the inductor. If the magnetic filed of the inductor is reinforced by the magnetic moments, a larger number of flux lines are created, thus increasing the inductance. There are essentially two cross-coupled inductors in a transformer. The inductance caused by flux coupling between the two inductors is called the mutual inductance. The mutual inductance is equal to the coupling coefficient of the two coils multiplied by the square root of the product of the inductance of each coil.

If the magnetic fields of the cross-coupled inductors are reinforced by the magnetic moments, a larger number of flux lines are created, thus increasing the mutual inductance of the transformer. The ability of a material to reinforce the magnetic fields of the cross-coupled inductors is determined by the permeability of the material. Permeability is the property of a material that describes the magnetization developed in that material when excited by a magnetic field. For an inductor, as is well known in the art, the magnitude of inductance is proportional to permeability of the materials that surround the inductor.

The mutual inductance of the present embodiment of the invention's transformer may be increased by increasing the permeability in any of dielectric layers 160, 162, or 164 in FIG. 1 (corresponding to dielectric layers 260, 262, and 264 in FIGS. 2B and 2C) or in a combination of any two of the dielectric layers or in all three of the dielectric layers.

One method that may be used in the present invention to increase permeability of dielectric layers 160, 162, and/or 164 is by introducing into the dielectric layer (or dielectric layers) atoms and/or molecules of high permeability materials. These high permeability atoms and/or molecules will increase the permeability of the dielectric layer significantly. The high permeability atoms and/or molecules can be introduced into the dielectric layer using ion implantation or ion sputtering techniques.

As an example, ion implantation can be used to introduce ions of high permeability materials into dielectric layers 160, 162, or 164 of the invention's transformer. More specifically, a high current ion implanter could be used to ionize and separate individual atoms of the high permeability material, such as iron or nickel, accelerate and form them into a beam which would be swept across the surface of the dielectric layer. The individual ions would penetrate the surface of the dielectric layer and come to a stop below the surface of the dielectric layer. It is noted that in the present application the term "ions" is used generally to refer to ionized atoms, ionized clusters of atoms, or ionized molecules. Also, the ion implanter used to implant ions in the dielectric layer is used in many other ion implantation steps required for fabricating semiconductor chips, such as to implant arsenic, boron, and argon ions into the chip to form doped regions on the chip.

As an example, iron ions could be implanted in any of the dielectric layers 160, 162, or 164 of the present invention's transformer to increase permeability. In the alternative, nickel ions or ions from other high permeability metals could be implanted. Further, a metal alloy can be implanted in dielectric layers 160, 162, or 164 of the invention's transformer by implanting ions of different metals in doses that correspond to the ratio of the different atoms in the alloy and in energies that give matched implantation depth profile. The different ions of the alloy can be implanted during separate implantation steps. This metal alloy implantation may be desirable, as some metal alloys have higher permeability than the individual metals alone. The above described technique for increasing dielectric permeability by implantation or sputtering of high permeability ions is disclosed in a co-pending United States patent application entitled "Method for Fabrication of On-Chip Inductors and Related Structure," Ser. No. 09/627,505 filed Jul. 28, 2000, and assigned to the assignee of the present application. The disclosure in that co-pending application is hereby incorporated fully by reference into the present application.

Other methods exist for increasing the permeability of the dielectric layer or layers through which the magnetic field flux lines traverse. For example, trenches can be etched into the dielectric regions next to the interconnect metal segments of the primary winding or the secondary winding of the transformer. The trenches are then filled with a material having a permeability substantially higher than the permeability of the dielectric. The high permeability material can be, for example, nickel, iron, nickel-iron alloy, or magnetic oxide. As a result, the inductance values of the primary and/or secondary windings of the transformer are significantly increased. This method for increasing dielectric permeability is disclosed in a co-pending United States patent application entitled "Method for Fabrication of High Inductance Inductors and Related Structure," Ser. No. 09/649,442 filed Aug. 25, 2000, and assigned to the assignee of the present application. The disclosure in that co-pending application is hereby incorporated fully by reference into the present application.

Another method for increasing the permeability of the pertinent dielectric layer or layers is to deposit a spin-on matrix containing high permeability particles in the pertinent dielectric layer or layers and immediately next to, below, or above, the interconnect metal segments that make up the primary winding or the secondary winding of the transformer. For example, the high permeability spin-on matrix can be deposited between interconnect metal segments forming the primary winding or the secondary winding of the transformer. The high permeability particles can comprise, for example, nickel, iron, nickel-iron alloy, or magnetic oxide. As a result, the inductance values of the primary and/or secondary windings of the transformer are significantly increased. This method for increasing dielectric permeability is disclosed in a co-pending United States patent application entitled "Method for Fabricating On-Chip Inductors and Related Structure," Ser. No. 09/658,483 filed Sep. 8, 2000, and assigned to the assignee of the present application. The disclosure in that co-pending application is hereby incorporated fully by reference into the present application.

Yet another method for increasing the permeability of the pertinent dielectric layer or layers is to deposit a blanket layer of high permeability material over the pertinent dielectric layer or layers. The high permeability layer can comprise, for example, nickel, iron, nickel-iron alloy, or magnetic oxide. The blanket deposition of the layer of high permeability material can be accomplished by, for example, a sputtering technique. After depositing the high permeability layer, a portion of the atoms or molecules in the high permeability material is driven into the underlying dielectric which surrounds the interconnect metal segments of the primary winding or the secondary winding of the invention's transformer. As a result, the permeability of the underlying dielectric and the inductance values of the primary and/or secondary windings of the transformer are significantly increased. This method for increasing dielectric permeability is disclosed in a co-pending United States patent application entitled "Method for Increasing Inductance of On-Chip Inductors and Related Structure," U.S. Ser. No. 09/668,790 filed Sep. 22, 2000, and assigned to the assignee of the present application. The disclosure in that co-pending application is hereby incorporated fully by reference into the present application.

The implantation, sputtering, or any of the other methods described above, used to introduce high permeability material into the dielectric material which surrounds an inductor is collectively referred to as "interspersing" in the present application. The high permeability material that is interspersed into the dielectric material is also referred to as a "permeability conversion material." Examples of permeability conversion material that are interspersed into the dielectric material are nickel, iron, nickel-iron alloy, and magnetic oxide.

The embodiment of the invention's transformer described in relation to FIGS. 1, 2A, 2B, and 2C achieves a small size relative to any known transformer in the art. One reason for achieving a small size is that through increasing the permeability of one or more of the dielectric layers 160, 162, or 164, higher inductance values for the primary and secondary windings of the invention's transformer are achieved. Moreover, because of the increase in the permeability of one or more of the dielectric layers 160, 162, or 164, the coupling coefficient between the invention's transformer's primary and second windings is also increased. The higher inductance and coupling coefficient values thus achieved in turn result in a more efficient transformer that occupies a much smaller area relative to any off-chip transformer. The small size of the invention's transformer makes possible the on-chip fabrication of the transformer which, as stated above, was previously unknown in the art.

One advantage of the small size of the present invention's on-chip transformer is that it can meet the need for decreasing electronic circuit component sizes and geometries. Moreover, another advantage of on-chip fabrication of the present embodiment of the invention's transformer is its long-term reliability. The interconnects of on-chip the invention's transformer are not subject to long-term damage from vibration, corrosion, chemical contamination, oxidation, and other chemical and physical forces because they are not exposed to those elements, but are inside the semiconductor chip.

The on-chip fabrication of the present invention's transformer is also cost-effective, since its fabrication can be easily assimilated into a process that is well known in the art, such as a CMOS process flow. The present embodiment of the invention's transformer does not require independent fabrication or assembly, as required by off-chip transformers. Also, the on-chip interconnect lines used for connecting to the present embodiment's transformer are extremely short compared to off-chip wires and off-chip interconnect lines that are necessary for connecting to off-chip transformers. As a result, the interconnect lines used for connecting various devices to the invention's transformer have very little unwanted resistance, capacitance, and inductance.

Further, the present embodiment of the invention's transformer benefits from the high quality factor of its inductors. As stated above, quality factor ("Q") of an inductor is proportional to its inductance, since the quality factor of an inductor is determined by $Q=L/R$, where L is the inductance and R is the resistance inherent in the inductor. Also, it is well known in the art that the inductance of an inductor is proportional to the permeability of the materials through which the magnetic field flux lines traverse. Since the permeability in any of dielectric layers 160, 162, or 164 is significantly increased through the various methods described above, the inductance of the invention's transformer's inductors and, therefore, the quality factors of those inductors, is also increased significantly.

Figure 3:
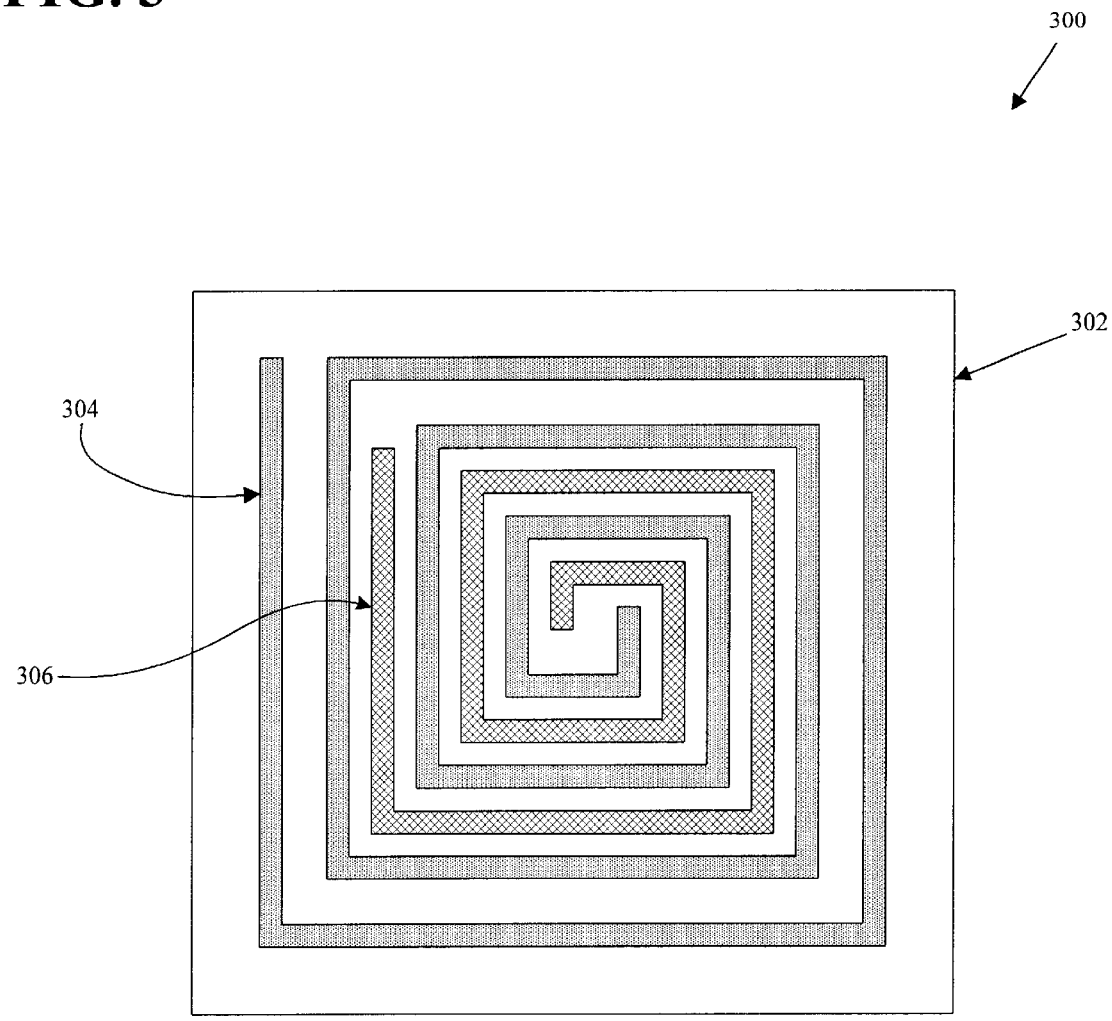
FIG. 3 illustrates a top view of another embodiment of the invention's transformer.

Another exemplary embodiment of the present invention's transformer is shown in FIG. 3. FIG. 3 shows a top view of the invention's transformer 300 in this exemplary embodiment. The dielectric layer in which the invention's transformer 300 is fabricated is referred to by numeral 302 in FIG. 3. The primary winding of the invention's transformer 300, also called a "first conductor" in the present application, is referred to by numeral 304 in FIG. 3. The secondary winding of the invention's transformer 300, also called a "second conductor" in the present application, is referred to by numeral 306 in FIG. 3. It is noted that for primary winding 304 and second winding 306, a connection to the "inside" terminals, i.e. the terminals at the respective centers of the windings, can be made by tapping into the inside terminals from a metal layer above or below the metal layer in which primary winding 304 and secondary winding 306 are fabricated. Moreover, a connection to the "outside" terminal of secondary winding 306 can be made by tapping into the outside terminal from a metal layer above or below the layer in which primary winding 304 and secondary winding 306 are fabricated. However, a connection to the "outside" terminal of primary winding 304 is typically made by using metal interconnect in the same metal layer in which primary winding 304 and secondary winding 306 are fabricated. Dielectric layer 302 in FIG. 3 can comprise silicon dioxide, or a low-k dielectric such as porous silica, fluorinated amorphous carbon, fluoro-polymer, parylene, polyarylene ether, silsesquioxane, fluorinated silicon dioxide, and diamondlike carbon.

In the present embodiment's transformer 300 in FIG. 3, primary winding 304 and secondary winding 306 may be patterned within dielectric layer 302 by either a damascene process or by a subtractive etching process. Both the damascene process and the subtractive etching process are well known in the art and were briefly described in the exemplary embodiment of the invention's transformer in relation to FIGS. 1, 2A, 2B, and 2C.

It is noted that one difference between the embodiment of the invention's transformer in FIG. 3 and the embodiment of the invention's transformer in FIGS. 1, 2A, 2B, and 2C is that in the embodiment of the invention's transformer in FIG. 3, all interconnect metal segments belong to the same metallization level and as such are patterned in the same dielectric layer, i.e. dielectric layer 302. In contrast, in the embodiment of the invention described in FIGS. 1, 2A, 2B, and 2C, the various interconnect metal segments of the primary and secondary windings in the transformer were distributed in two different metallization levels and were interconnected by means of vias. Thus, while a number of interconnect metal segments were patterned in dielectric layer 260 in FIGS. 2A, 2B, and 2C, other interconnect metal segments were patterned in dielectric layer 264 in FIGS. 2B and 2C. For example, if interconnect metal segments in dielectric layer 260 are made in metallization level three, the interconnect metal segments in dielectric layer 264 are made in metallization level two.

The permeability of dielectric layer 302 in FIG. 3 may be increased by introducing into dielectric layer 302 atoms and/or molecules of high permeability materials through the techniques of implantation or ion sputtering. The permeability of dielectric layer 302 may also be increased by any of the other methods described in the exemplary embodiment of the invention's transformer in relation to FIGS. 1, 2A, 2B, and 2C. The present invention's transformer 300 achieves the same advantages of small size, high quality factor inductor windings, reliability, cost-effectiveness, and elimination of the requirement of connections through off-chip wires or off-chip interconnect lines, described in the exemplary embodiment of the present invention's transformer in FIGS. 1, 2A, 2B, and 2C.

Figure 4:
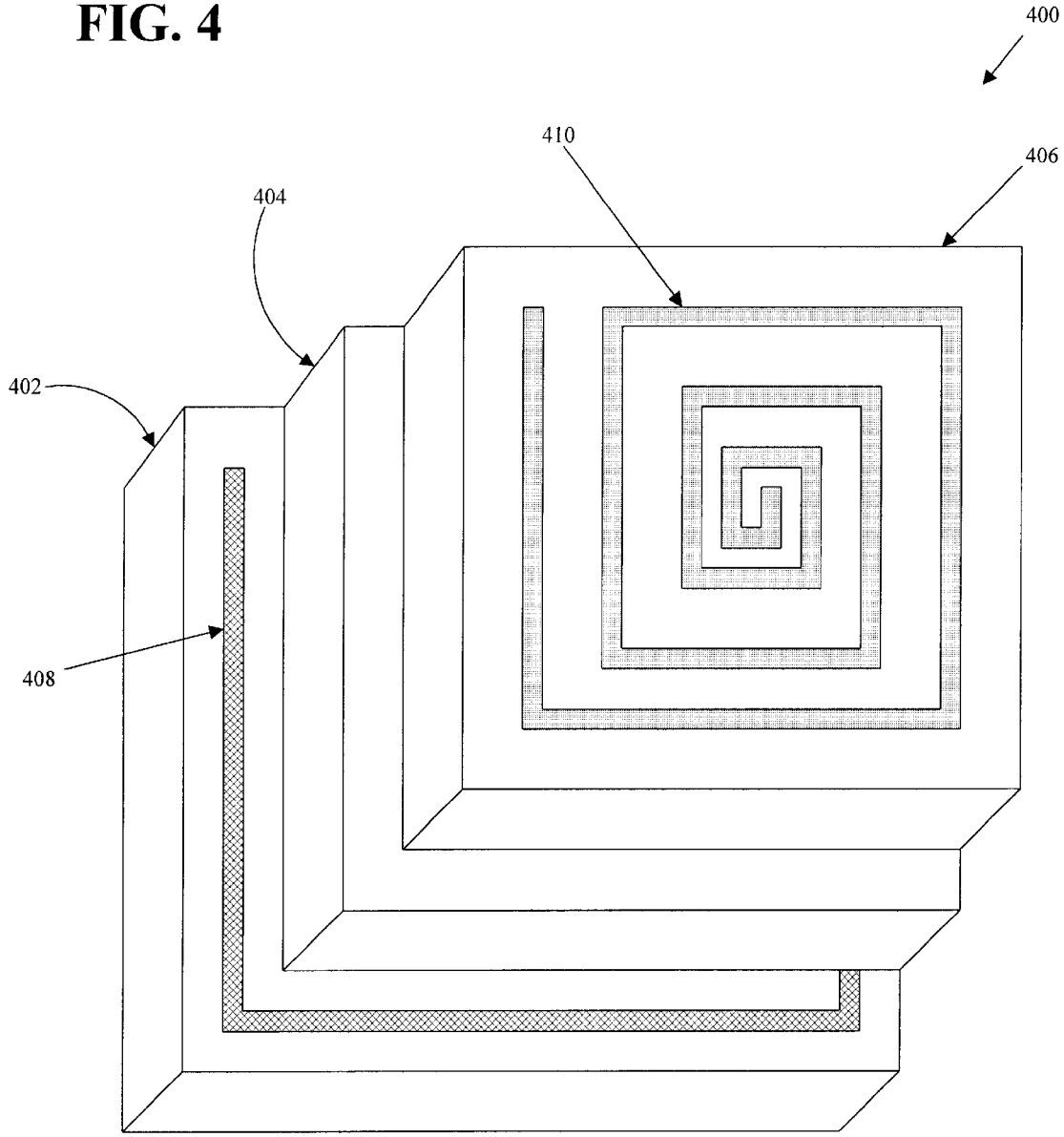
FIG. 4 illustrates a perspective view of yet another embodiment of the invention's transformer.

Yet another exemplary embodiment of the present invention's transformer is shown in FIG. 4. FIG. 4 shows a perspective view of the invention's transformer 400. The primary winding of the invention's transformer 400, also called a "first conductor" in the present application, is referred to by numeral 408 in FIG. 4. The secondary winding of the invention's transformer 400, also called a "second conductor" in the present application, is referred to by numeral 410 in FIG. 4. The dielectric layer of the invention's transformer 400 in FIG. 4 in which primary winding 408 is patterned is referred to by numeral 402. The dielectric layer of the invention's transformer 400 in FIG. 4 in which secondary winding 410 is patterned in is referred to by numeral 406. The dielectric layer of the invention's transformer 400 in FIG. 4 that is between dielectric layer 402 and dielectric layer 406 is referred to by numeral 404. For illustration purposes, primary winding 408 of transformer 400 in FIG. 4 is shown larger than secondary winding 410, and not directly under secondary winding 410. However, in the exemplary embodiment of the present invention's transformer 400 in FIG. 4, primary winding 408 can be directly under secondary winding 410 and can be of the same size as secondary winding 410. In the present invention's transformer 400 in FIG. 4, dielectric layers 402, 404, and 406 can comprise silicon dioxide, or any of the low-k dielectrics mentioned in the exemplary embodiment of the present invention's transformer in FIGS. 1, 2A, 2B, and 2C.

As in the prior exemplary embodiments of the present invention, the permeability in any of the dielectric layers 402, 404, or 406 in FIG. 4, or in a combination of any two of the dielectric layers, or in all three of the dielectric layers, may be increased by introducing into any of the dielectric layers 402, 404, or 406 atoms and/or molecules of high permeability materials through the method of implantation or ion sputtering. The permeability of dielectric layer 402, 404, or 406 may also be increased by any of the other methods described in the first exemplary embodiment of the invention's transformer in FIGS. 1, 2A, 2B, and 2C.

A difference between the present embodiment of the invention's transformer and the embodiment of the invention's transformer discussed in relation to FIGS. 1, 2A, 2B, and 2C is that in the present embodiment the entire primary winding is patterned in a single dielectric layer while the entire secondary winding is also patterned in a single, but a separate, dielectric layer. In other words, each of the primary and secondary windings are fabricated in their own separate dielectric layers. In contrast, in the embodiment of the invention's transformer shown described in relation to FIGS. 1, 2A, 2B, and 2C, the primary winding is distributed within three dielectric layers, i.e. dielectric layers 160, 162, and 164 as shown in FIG. 1. Likewise, the secondary winding is also distributed within the same three dielectric layers, i.e. dielectric layers 160, 162, and 164 as shown in FIG. 1.

A difference between the embodiment of the invention's transformer shown in FIG. 4 and the embodiment of the invention's transformer shown in FIG. 3 is that in the embodiment of the invention shown in FIG. 4, the entire primary winding is patterned in a single dielectric layer while the entire secondary winding is also patterned in a single, but a separate, dielectric layer. In other words, each of the primary and secondary windings are fabricated in their own separate dielectric layers. In contrast, in the embodiment of the invention shown in FIG. 3, both the primary winding and the secondary winding of the invention's transformer are patterned in a single, and the same, dielectric layer.

It is noted that the exemplary embodiment of the present invention's transformer 400 in FIG. 4 also achieves the advantages of small size, high quality factor inductor windings, reliability, cost-effectiveness, and elimination of the requirement of connections through off-chip wires or off-chip interconnect lines, as described in the first exemplary embodiment of the present invention's transformer in FIGS. 1, 2A, 2B, and 2C.

While certain embodiments of the invention are illustrated in the drawings and are described herein, it is apparent to those of ordinary skill in the art that the specific embodiments described herein may be modified without departing from the inventive concepts described. For example, various combinations of materials may be used in various dielectric layers, examples of which are low dielectric constant materials such as porous silica, fluorinated amorphous carbon, fluoro-polymer, parylene, polyarylene ether, silsesquioxane, fluorinated silicon dioxide, and diamondlike carbon, to meet certain design requirements. In addition, various combinations of techniques known in the art may be used to accomplish the invention's concepts described herein.

Thus, on-chip transformers have been described.

What is claimed is:

1. A structure in a semiconductor chip, said structure comprising:

a dielectric area having a first permeability;

a permeability conversion material having a second permeability, said permeability conversion material being interspersed within said dielectric area, wherein said second permeability is greater than said first permeability;

a first conductor patterned into said dielectric area, said first conductor having a first plurality of turns;

a second conductor patterned into said dielectric area, said second conductor having a second plurality of turns.

2. The structure of claim 1 wherein said dielectric area comprises at least three dielectric layers.

3. The structure of claim 1 wherein said dielectric area comprises a plurality of dielectric layers, wherein said first conductor is in a first dielectric layer of said plurality of dielectric layers, wherein said second conductor is in a third dielectric layer of said plurality of dielectric layers, and wherein a second dielectric layer of said plurality of dielectric layers is situated between said first and third dielectric layers.

4. The structure of claim 3 wherein said plurality of dielectric layers comprise a low-k dielectric.

5. The structure of claim 3 wherein said plurality of dielectric layers comprise silicon dioxide.

6. The structure of claim 1 wherein said dielectric area comprises a low-k dielectric.

7. The structure of claim 1 wherein said permeability conversion material is selected from the group consisting of nickel, iron, nickel-iron alloy, and magnetic oxide.

8. The structure of claim 1 wherein said dielectric area comprises silicon dioxide.

9. The structure of claim 1 wherein said first conductor is selected from the group consisting of copper, aluminum, and copper-aluminum alloy.

10. The structure of claim 1 wherein said second conductor is selected from the group consisting of copper, aluminum, and copper-aluminum alloy.

11. A structure in a semiconductor chip, said structure comprising:

a first dielectric layer;

a second dielectric layer situated over said first dielectric layer, said second dielectric layer being interspersed with a permeability conversion material;

a third dielectric layer situated over said second dielectric layer;

a primary winding patterned into said first, second, and third dielectric layers;

a second winding patterned into said first, second, and third dielectric layer.

12. The structure of claim 11 wherein said primary winding comprises a plurality of interconnect metal segments in said first dielectric layer and a plurality of interconnect metal segments in said third dielectric layer.

13. The structure of claim 12 wherein a plurality of via metal segments in said second dielectric layer interconnect said plurality of interconnect metal segments in said first dielectric layer with said plurality of interconnect metal segments in said third dielectric layer.

14. The structure of claim 11 wherein said secondary winding comprises a plurality of interconnect metal segments in said first dielectric layer and a plurality of interconnect metal segments in said third dielectric layer.

15. The structure of claim 14 wherein a plurality of via metal segments in said second dielectric layer interconnect said plurality of interconnect metal segments in said first dielectric layer with said plurality of interconnect metal segments in said third dielectric layer.

16. The structure of claim 11 wherein said first dielectric layer is interspersed with a permeability conversion material.

17. The structure of claim 11 wherein said third dielectric layer is interspersed with a permeability conversion material.

18. The structure of claim 11 wherein said first and said third dielectric layers are interspersed with a permeability conversion material.

19. The structure of claim 11 wherein said permeability conversion material is selected from the group consisting of nickel, iron, nickel-iron alloy, and magnetic oxide.

* * * * *